US006891335B2

(12) United States Patent
Aleardi

(10) Patent No.: US 6,891,335 B2
(45) Date of Patent: May 10, 2005

(54) ELECTRIC GAS LIGHTING DEVICE

(75) Inventor: Massimo Aleardi, Cassano Magnago (IT)

(73) Assignee: ITW Industrial Components S.r.l., Milan (IT)

( * ) Notice: Subject to any disclaimer, the term of this patent is extended or adjusted under 35 U.S.C. 154(b) by 0 days.

(21) Appl. No.: 10/689,526

(22) Filed: Oct. 21, 2003

(65) Prior Publication Data

US 2004/0183447 A1 Sep. 23, 2004

(30) Foreign Application Priority Data

Oct. 22, 2002 (IT) ..... TO2002A0921

(51) Int. Cl.[7] ..... H05B 37/02

(52) U.S. Cl. ..... 315/209 CD; 361/253; 361/263

(58) Field of Search ..... 315/209 CD, 239, 315/311, 209 T, 206–208, 85; 361/253, 256, 257, 263

(56) References Cited

U.S. PATENT DOCUMENTS 4,143,303 A * 3/1979 Goble et al. ..... 315/239
4,358,813 A * 11/1982 Sato et al. ..... 361/263
6,242,866 B1 * 6/2001 Bianchi ..... 315/209 CD
6,449,138 B2 * 9/2002 Aleardi ..... 361/253

* cited by examiner

*Primary Examiner*—Wilson Lee
(74) *Attorney, Agent, or Firm*—Lowe Hauptman & Berner, LLP

(57) ABSTRACT

An electric gas lighting device including an ignition circuit for generating sparks at at least one burner and connected to a supply line, supplying a supply voltage, via enabling means for alternatively enabling/disabling spark generation when connected/disconnected to/from a reference potential line; the enabling means are defined by a secondary winding of an isolation transformer interposed between the supply line and the ignition circuit; a first terminal of the secondary winding of the isolation transformer is connected to a first terminal of hand-operated switch means, a second terminal of which is connected to the reference potential line; and the ignition circuit also includes a discharge generating circuit, a first node of which is connected to the reference potential line, and a second node of which is connected to a second terminal of the secondary winding of the isolation transformer.

7 Claims, 2 Drawing Sheets

ELECTRIC GAS LIGHTING DEVICE

The present invention relates to an electric gas lighting device, which may be used on a cooking range of a gas cooker.

BACKGROUND OF THE INVENTION

Electric gas lighting devices are known which are used for producing sparks to light burners on gas cooker ranges, and which normally comprise an ignition circuit fitted underneath the cooking range and for generating sparks, and one or more switches operated manually to activate the ignition circuit.

More specifically, the ignition circuit is connected to a supply line having a neutral line and a phase line and supplying alternating supply voltage, and comprises two enabling terminals, one of which is connected to the neutral line. Alternatively, the mains may be used to drive the charge circuit.

The normally-open hand-operated switches are connected in parallel between the enabling terminals of the ignition circuit, and, being operated manually by the user, are formed on a flame regulating panel of the cooking range.

A drawback of known gas lighting devices of this type lies in the hand-operated switches being located some distance from the ignition circuit, so that two conducting wires, for electrical connection and return, must be routed to each, thus making them bulky and expensive to install.

To overcome the above drawback, the Applicant's co-pending Italian Patent Application MI2000A002814 proposes using a single-wire control catenary, with return via the cooking range made of appropriately earthed conducting material. Such a solution, however, cannot be applied in the case of mains-driven charge circuits, by being electrically unsafe. What is more, when applied (as in the above patent application), it calls for relatively complex, high-cost ignition circuits with appropriate radio noise filters.

SUMMARY OF THE INVENTION

It is an object of the present invention to provide a gas lighting device designed to eliminate the aforementioned drawbacks, and which in particular is compact, is cheap and easy to produce, and can be fitted easily to a cooking range.

According to the present invention, there is provided an electric gas lighting device comprising an ignition circuit for generating sparks at at least one burner of a cooking range; said ignition circuit being connected to a supply line supplying a supply voltage, and comprising a discharge generating circuit, and enabling means for alternatively enabling and disabling spark generation in the discharge generating circuit when connected to and, respectively, disconnected from a reference potential line; said electric gas lighting device also comprising hand-operated switch means having at least a first terminal connected to a first terminal of said enabling means by a connecting line defined by a single insulated conductor, and at least a second terminal connected to said reference potential line; characterized in that a first node of said discharge generating circuit is connected to said reference potential line, and a second node of said discharge generating circuit is connected to a second terminal of said enabling means.

More specifically, the device comprises an isolation transformer interposed between said ignition circuit and said supply line, and said enabling means are defined by a secondary winding of the isolation transformer, the opposite terminals of a primary winding of which are connected to said supply line and a neutral line.

A single-wire control catenary can thus be used in absolute safety, even in the case of a mains-driven charge/discharge circuit. Moreover, a standard catenary for any application can be used, regardless of the number of burners being controlled. Downstream from the isolation transformer, which has surprisingly proved capable of ensuring electrical safety of the system on its own, the ignition circuit and the discharge generating circuit included in it may be simplified greatly to reduce cost and size, and current standards can surprisingly be met with no need for noise filters.

BRIEF DESCRIPTION OF THE DRAWINGS

A non-limiting embodiment of the present invention will be described by way of example with reference to the accompanying drawings, in which.

DETAILED DESCRIPTION OF THE INVENTION

As shown in the above drawings, an electric gas lighting device, indicated as a whole by 1, is connected to a cooking range 2 of a gas cooker (not shown). More specifically, gas lighting device 1 is at least partly housed incise a casing 1*b* clicked or bayonet-connected in known manner to cooking range 2.

Cooking range 2, which is made of conducting material, preferably metal, comprises a number of burners 3 (FIG. 2) connected to respective regulating knobs 4 (only one shown in FIG. 3) for regulating gas flow through burners 3.

Figure 1:
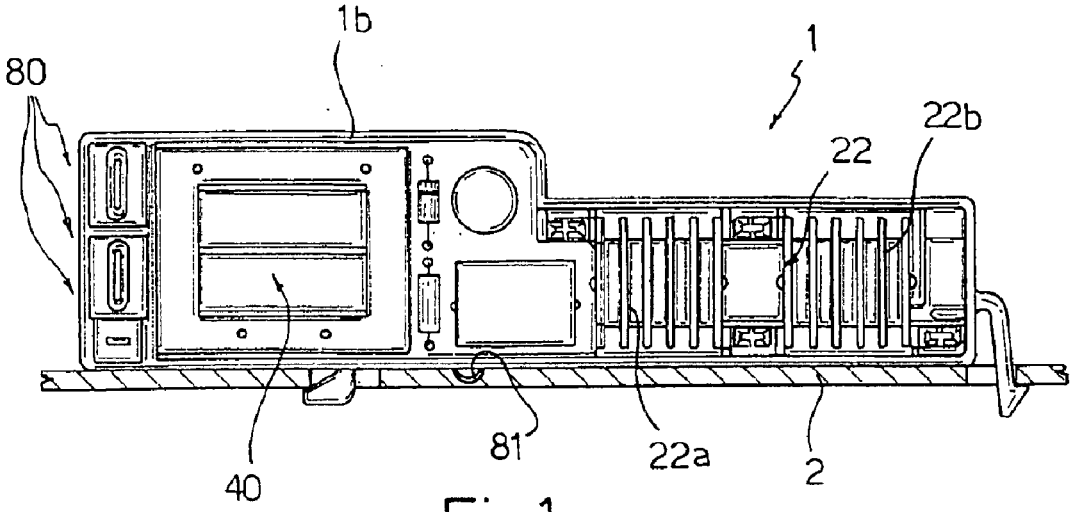
FIG. 1 shows a schematic view of a lighting device in accordance with the present invention applied to a cooking range.
Figure 2:
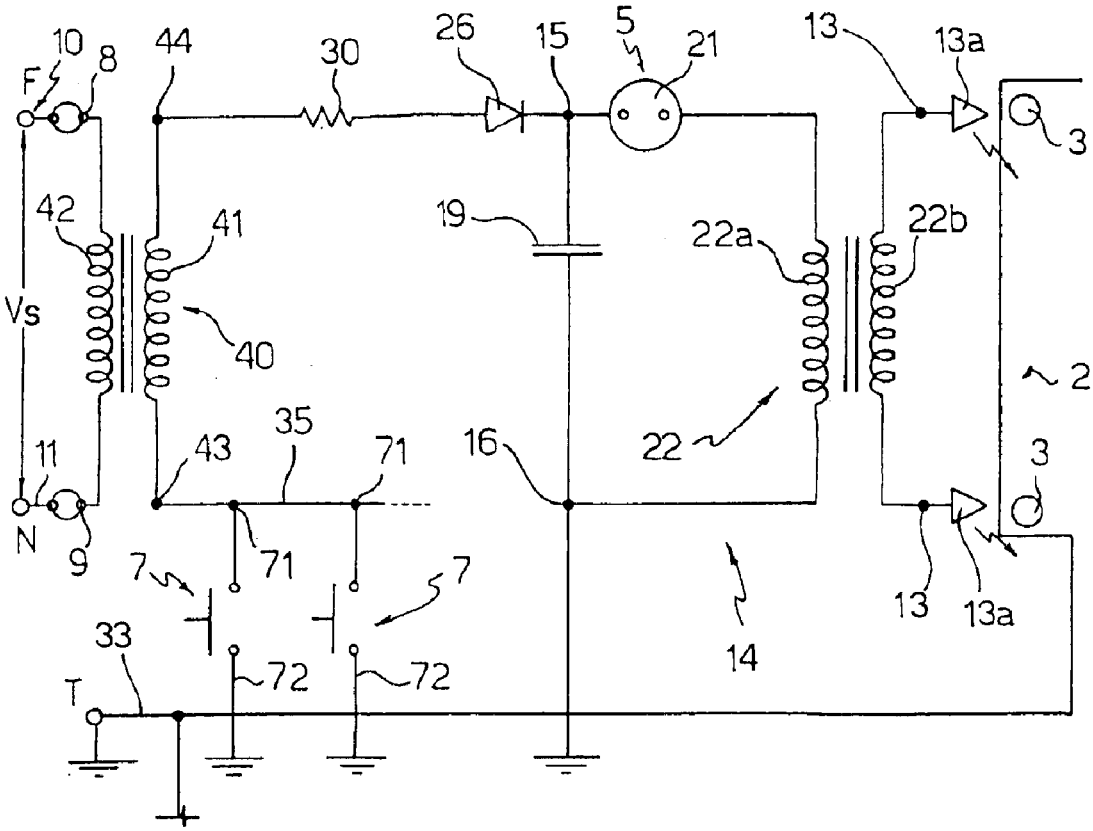
FIG. 2 shows a schematic circuit diagram of the FIG. 1 gas lighting device.
Figure 3:
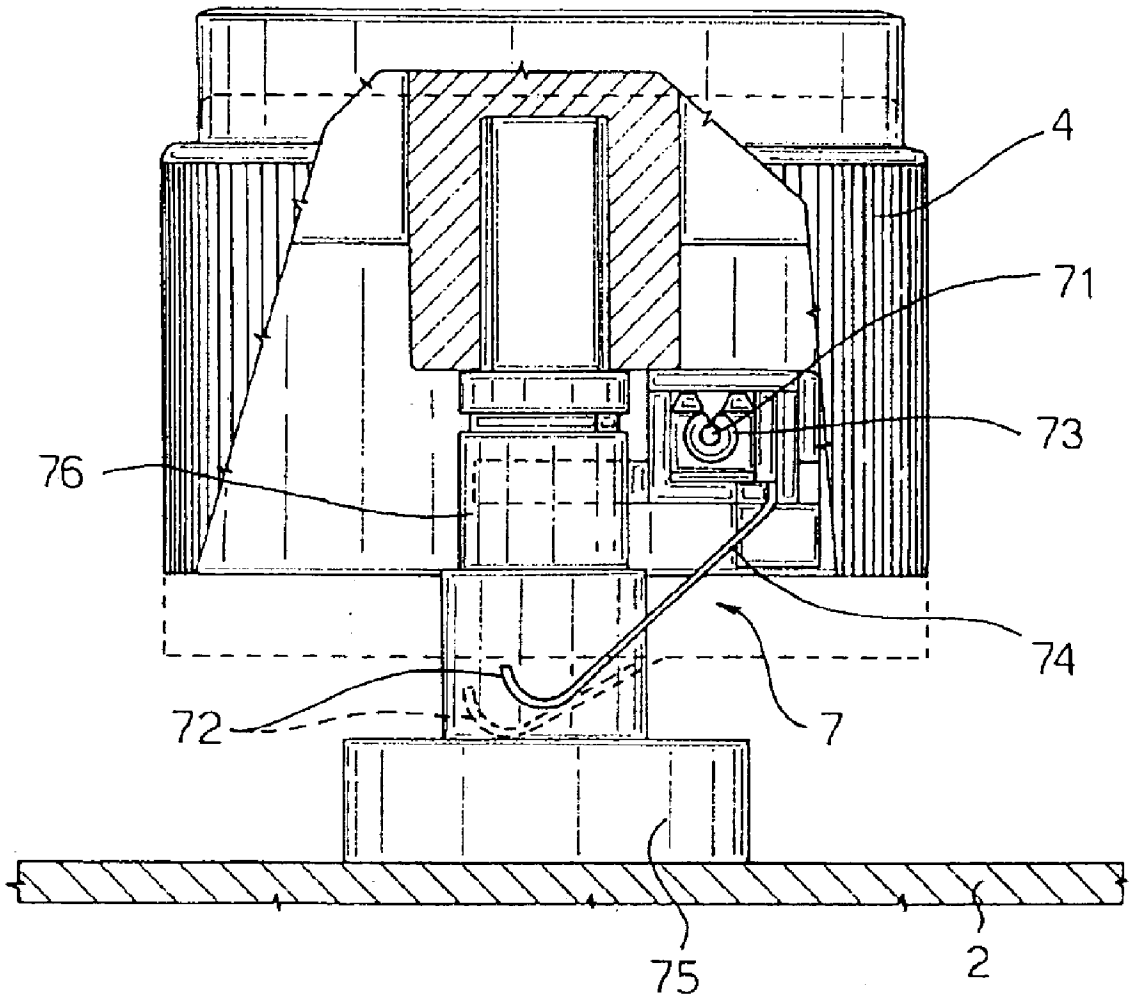
FIG. 3 shows a larger-scale schematic detail of the construction of switch means employed in the FIG. 2 circuit.

Gas lighting device 1 comprises an ignition circuit 5 (FIG. 2) housed in use inside casing 1*b* and for generating sparks at burners 3; and hand-operated switch means 7 defined by a number of switches 7, each formed at a respective regulating knob 4, preferably as shown in FIG. 3. One hand-operated switch 7 is therefore provided for each regulating knob 4, i.e. for each burner 3.

Ignition circuit 5 comprises a first and a second input terminal 8, 9 connected respectively to a phase supply line 10 and a neutral line 11, which supply an alternating supply voltage $V_s$; and output terminals 13 connected to respective electrodes 13*a*, located close to burners 3 and insulated electrically from cooking range 2, to generate sparks (shown schematically in FIG. 2) by which to initiate combustion of the gas.

Ignition circuit 5 comprises a discharge generating circuit 14, in turn comprising a capacitor 19 located between a first and second node 16, 15, a discharger 21, and a transformer 22. Discharger 21—preferably a gas discharge tube (GDT)—has one terminal connected to first node 15, and is connected in series with a primary winding 22*a* of transformer 22, in turn connected to second node 16. Transformer 22 also comprises at least one secondary winding 22*b* (one for every two burners 3) connected between two respective output terminals 13 of ignition circuit 5.

Ignition circuit 5 also comprises enabling means for alternatively enabling and disabling spark generation in discharge generating circuit 14 when connected to and, respectively, disconnected from a reference potential or earth line 33.

According to a first aspect of the invention, gas lighting device 1 comprises an isolation transformer 40 interposed between ignition circuit 5 and supply line 10, so that said enabling means are defined, according to the invention, by a secondary winding 41 of isolation transformer 40.

More specifically, a primary winding 42 of isolation transformer 40 has a first terminal connected to supply line 10, and an opposite second terminal connected to neutral line 11.

Secondary winding 41, on the other hand, has a first terminal 43 connected to respective first terminals 71 of hand-operated switches 7 by a conducting wire 35; and a second terminal 44 connected to node 15 by a branch of ignition circuit 5 comprising a rectifying diode 26, which has the cathode connected in series with and upstream from second 15 (so that capacitor 19 is connected downstream from rectifying diode 26), and the anode connected in series, via an input resistor 30, to second terminal 44 of secondary winding 41 of isolation transformer 40.

The second terminals 72 of hand-operated switches 7 are connected to reference potential line 33, so that hand-operated switches 7 are connected in parallel with each other, between connecting line 35 and reference potential or earth line 33. Hand-operated switches 7 are normally-open types, and are closed, thus connecting terminal 43 to earth line 33, when the corresponding regulating knobs 4 are pressed.

In the non-limiting example shown (FIG. 3), each hand-operated switch 7 comprises a support attachment 73 housed as shown inside a respective knob 4 and having a corresponding terminal 71; and a rocking blade 74 made of electrically conducting material, connected electrically to terminal 71, and projecting internally and beneath respective knob 4 towards cooking range 2 underneath knob 4.

Blades 74 are preferably elastic and/or hinged to respective supports 73, are connected to line 35 in known manner by terminals 71, and each terminate with a rounded free end defining respective terminal 72 of each switch 7. As shown by the dash line in FIG. 3, when a knob 4 is pressed towards cooking range 2 underneath to feed gas to the controlled burner 3, blade 74 moves towards cooking range 2 integrally with knob 4, so that end 72 electrically contacts cooking range 2 (either directly or by means of a connecting ring 75 of a gas tap 76, made of conducting metal material, controlled by knob 4, and fixed integrally to cooking range 2), thus closing relative switch 7 which, until then, was floating.

According to a further aspect of the invention, first node 16 of discharge generating circuit 14, to which one of the terminals of capacitor 19 is connected directly, is also connected to reference potential or earth line 33.

In other words, as shown schematically in FIG. 2, second terminal 72 of each switch 7 and first node 16 of discharge generating circuit 14 are therefore connected to reference potential line 33 directly or indirectly via cooking range 2. Line 33 in fact may be connected in use to a contact 80 on casing 1*b*, and, via circuit 5, to electrically conducting cooking range 2 by an earth contact 81 projecting from casing 1*b* and also connected to circuit 5.

All the components described are housed separately inside casing 1*b*, e.g. isolation transformer 40 at the end of casing 1*b* having contacts 80, and transformer 22 at the opposite end, with windings 22*a* and 22*b* housed separately in tandem to "isolate" the high-voltage part of circuit 5 as much as possible. Ignition circuit 5 and hand-operated switches 7 are therefore only connected to one another by a single insulated conducting wire 35, which can easily be placed-on and fixed to cooking range 2.

Gas lighting device 1 operates as follows. When one of switches 7 switches from the floating to the closed state, transformer 40 is activated, so that current flows downstream from it to circuits 5 and 14, which are closed on earth line 33; capacitor 19 is therefore charged and discharger 21 activated; and transformer 22 increases the discharge voltage as required to produce sparks at electrodes 13*a*. Conversely, when switches 7 are all floating, transformer 40 isolates circuits 5 and 14 from line 10, so that no current flows in them and they remain idle. Tests clearly show that, in use, transformer 40 also cuts off any readiofrequency noise generated by discharge circuit 14, thus eliminating the need for filters.

Clearly, changes may be made to the gas lighting device as described herein without, however, departing from the scope of the present invention. In particular, hand-operated switches 7 described may be replaced with a single hand-operated, pushbutton switch operated separately and independently from regulating knobs 4 and connected between earth line 33 and terminal 43 by conducting wire 35. Ignition circuit 5 may also be formed differently.

What is claimed is:

1. An electric gas lighting device (1) comprising an ignition circuit (5) for generating sparks at at least one burner (3) of a cooking range (2); said ignition circuit (5) being connected to a supply line (10) supplying a supply voltage ($V_s$), and comprising a discharge generating circuit (14), and enabling means (41) for alternatively enabling and disabling spark generation in the discharge generating circuit (14) when connected to and, respectively, disconnected from a reference potential line (33); said electric gas lighting device also comprising hand-operated switch means (7) having at least a first terminal (71) connected to a first terminal (43) of said enabling means (41) by a connecting line (35) defined by a single insulated conductor, and at least a second terminal (72) connected to said reference potential line (33); characterized in that a first node (16) of said discharge generating circuit (14) is connected to said reference potential line (33), and a second node (15) of said discharge generating circuit (14) is connected to a second terminal (44) of said enabling means (41).

2. A gas lighting device (1) as claimed in claim 1, characterized by comprising an isolation transformer (40) interposed between said ignition circuit (5) and said supply line (10).

3. A gas lighting device (1) as claimed in claim 2, characterized in that said enabling means (41) are defined by a secondary winding (41) of said isolation transformer (40), the opposite terminals of a primary winding (42) of which are connected to said supply line (10) and a neutral line (11).

4. A gas lighting device (1) as claimed in claim 3, characterized in that said ignition circuit (5) comprises:

at least one output terminal (13, 13*a*) for generating sparks at said at least one burner (3);

a transformer (22) having a primary winding (22*a*) connected between said first and said second node (16, 15) of said discharge generating circuit (14), and at least one secondary winding (22*b*) connected to said at least one output terminal (13, 13*a*);

a rectifying diode (26) connected between said second terminal (44) of said secondary winding (41) of the isolation transformer (40) and said second node (15) of the discharge generating circuit (14);

a capacitor (29) connected between said first and said second node (16, 15), downstream from said rectifying diode (26); and discharge means (21) connected in series to said primary winding (22*a*) of said transformer (22) of the ignition circuit (5).

5. A gas lighting device (1) as claimed in claim 1, characterized in that said hand-operated switch means (7) comprise a number of hand-operated switches (7) connected in parallel between said connecting line (35) and said reference potential line (33); said hand-operated switches (7) being one in number for each of said burners (3), and being operated by means of respective regulating knobs (4).

6. A gas lighting device (1) as claimed in claim 5, characterized in that said hand-operated switches (7) each comprise an attachment (73) housed inside a respective said knob (4); and a rocking blade (74), connected to said first terminal (71) by said attachment (73) and projecting from the inside and beneath said knob towards said cooking range (2).

7. A gas lighting device (1) as claimed in claim 6, characterized in that said second terminal (72) of said hand-operated switch means (7) and said first node (16) of the discharge generating circuit (14) are connected to said reference potential line (33) via said cooking range (2).

* * * * *